US007791542B2

(12) United States Patent
Takei

(10) Patent No.: US 7,791,542 B2
(45) Date of Patent: Sep. 7, 2010

(54) SKELETON EQUALIZING ANTENNA, RFID TAG AND RFID SYSTEM USING THE SAME

(75) Inventor: Ken Takei, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 343 days.

(21) Appl. No.: 12/081,901

(22) Filed: Apr. 23, 2008

(65) Prior Publication Data

US 2008/0266183 A1 Oct. 30, 2008

(30) Foreign Application Priority Data

Apr. 27, 2007 (JP) ..... 2007-119413

(51) Int. Cl.
*H01Q 1/12* (2006.01)

(52) U.S. Cl. ..... 343/700 MS; 340/572.7

(58) Field of Classification Search ..... 343/700 MS; 340/572.5, 572.7

See application file for complete search history.

(56) References Cited

U.S. PATENT DOCUMENTS 2,064,481 A * 12/1936 Mathieu ..... 455/124
4,613,870 A * 9/1986 Stonier ..... 343/915
4,811,034 A * 3/1989 Kaminskas ..... 343/915
5,304,998 A * 4/1994 Lopez ..... 343/767
6,175,723 B1 * 1/2001 Rothwell, III ..... 455/63.1
7,439,926 B2 * 10/2008 Mikami et al. ..... 343/789
2003/0103015 A1 * 6/2003 Oh et al. ..... 343/867

OTHER PUBLICATIONS

Klaus Finkenzeller, RFID Handbook 2nd Edition (May 2004), 3 pages in Japanese, and 7 pages of English translation.

* cited by examiner

*Primary Examiner*—Tho G Phan
(74) *Attorney, Agent, or Firm*—Stites & Harbison, PLLC; Juan Carlos A. Marquez, Esq

(57) ABSTRACT

The problems to be solved by the present invention are to provide an antenna which is applied to a wireless identification system wherein there is a long distance between a device to execute identification and a device attached to an object to be identified and which does not cause deterioration in aesthetic terms and covering of a meaningful symbol, and further to provide a wireless system using the antenna. According to the present invention, there are provided an antenna having a circularly polarizing function and a frequency equalizing function achieved by a grid structure having roughness and fineness around a feeding point and density which allows visible light to pass through, an RFID tag using the antenna, and an RFID system using the tag.

20 Claims, 12 Drawing Sheets

SKELETON EQUALIZING ANTENNA, RFID TAG AND RFID SYSTEM USING THE SAME

CLAIM OF PRIORITY

The present application claims priority from Japanese application JP2007-119413 filed on Apr. 27, 2007, the content of which is hereby incorporated by reference into this application.

FIELD OF THE INVENTION

The present invention relates to a skeleton equalizing antenna, and an RFID tag and an RFID system using the same. In particular, it relates to an antenna used for a case where there is a long distance between a base station and a terminal and to a wireless system including the base station provided with the antenna and the terminal.

BACKGROUND OF THE INVENTION

In a system where a scattered wave is used as a direct carrier wave between a base station and a terminal, there is known a conventional technology, which may also be called a "Direction Divide Duplex (DDD)." In this technology, by using a difference in directionality between an electromagnetic wave leaving the base station and an electromagnetic wave entering the base station, with use of a circulator, a transmitted wave and a received wave are equivalently duplicated. This technology is disclosed in RFID Handbook 2 nd edition, Klaus Finkenzeller, Translated by Software Engineering Laboratory, The Nikkan Kogyo Shimbun, Ltd., page 45, May 2004.

SUMMARY OF THE INVENTION

With the increase in amount of physical distribution and the increase in speed of distribution, usefulness of a technology identifying unspecified many objects has been highly valued in recent years. In order to identify objects in large quantity and at high speed, since the spatial relationship of the objects cannot be specified, application of information transmitting means to be provided in such objects is indispensable. For such use, a wireless technology is suitable. In particular, a technology using electromagnetic waves for detecting an object and transmitting information contained in the object is already realized, for example, as a wireless tag system.

However, with the increase in speed and amount of distribution, there is a social demand for improving capability of object detection and information transmission using the electromagnetic wave, that is, for allowing the electromagnetic wave to travel a longer distance in the above system. An electromagnetic wave is weakened in proportion to about the second to third power of the transmission distance. Therefore, if the transmission distance becomes longer, when the electromagnetic wave emitted from the base station arrives at the base station again, its electric power is decreased remarkably, and its tolerance to various disturbance factors becomes very low.

In such a system, in order to send the energy of the electromagnetic wave having arrived from a base station to the base station again with least possible conversion loss, such a method is popular that uses a scattered electromagnetic filed itself from the object to be identified as a carrier wave for transmission of information. In order to generate a new carrier wave by a certain measure, it is necessary to convert the high-frequency electric power of the electromagnetic wave to a power-supply electric power for the certain measure. In this regard, a conversion loss inevitably takes place in reality. In wireless transmission using electromagnetic waves, the electric power given to a carrier wave restricts a range of the electromagnetic wave to cover. Therefore, making the electric power efficiency of the carrier-wave generation maximum leads to maximize the range of the electromagnetic wave in the system, that is, to maximize the applicable limit of the system.

In a system using the "Direction Divide Duplex" shown in FIG. 3. 21 of the above RFID Handbook 2nd edition, a circulator is used as a directional coupler. The output power of a carrier-wave generator, which is a source of electromagnetic waves sent from the base station, is emitted from an antenna through the circulator. The electromagnetic wave sent from the base station arrives at a terminal. The energy of the electromagnetic wave is taken in by the antenna mounted on the terminal and is converted to a direct-current power supply in a rectifier circuit. Then, modulation is applied on load impedance of the antenna by a modulation circuit using the direct-current power supply. The electromagnetic wave, which arrives at the base station again as an electromagnetic wave whose amplitude is modulated, is guided to the circulator through the antenna. However, because of a non-reciprocal characteristic of the circulator, it is transmitted not to the carrier-wave generator but to a receiving circuit.

According to the technology disclosed in the above RFID Handbook 2nd edition, the base station distinguishes the transmitted wave from the received wave by taking into account that electromagnetic waves of reverse directions passing through the circulator are mutually independent. Therefore, a radiation field is used with respect to the electromagnetic waves. The radiation field enables the electric power to be transmitted longer as compared with an inductive filed and a vicinity field, which are other two fields. However, it is desirable that a dimension of the antenna which delivers and receives the energy of the electromagnetic wave is of about the size of the wavelength.

On the other hand, in the actual wireless communication, there exist features of frequencies of the electromagnetic waves which can travel over a long distance depending on dusts, moisture, etc. in the air. To be specific, a frequency band between 300 MHz to 3 GHz is suitable for long distance communications and is used for mobile wireless transmission etc. In the above frequency band, the frequency between 800 MHz and 900 MHz in particular is suitable for the long distance communication because of the actual priority in propagation characteristics and feasibility of a high-frequency circuit and an antenna. In terms of a wavelength, this frequency is around 40 cm. As a result, the size of the antenna for realizing the long distance communication is also around 40 cm.

Further, in the system for identifying objects by use of wireless technology, in the vicinity of a device (a base station) for carrying out identification and a device (a terminal) attached to an object to be identified, there occurs reflection and diffraction of electromagnetic waves because of a floor, a wall, utensils, etc. which scatter the electromagnetic waves. In particular, the presence of a reflected wave causes fading peculiar to an undulation phenomenon because an arrival way of the electromagnetic wave from the base station to the terminal or from the terminal to the base station is different from the direct arrival way, and considerable disturbance is exerted on the strength of the electromagnetic wave at the base station and the terminal.

The communicable distance of the wireless system is restrained when strength of a magnetic field is decreased by the disturbance. Therefore, in order to extend the communicable distance of the wireless system, it is important to suppress the fading. An effective measure to suppress fading is to give an antenna a circular polarization characteristic. A circularly polarized antenna is hardly sensitive to electromagnetic waves polarized in a different rotational direction. Every time the circularly polarized electromagnetic wave is reflected, the rotational direction of the polarized wave is reversed. Therefore, by applying the circularly polarized antenna to the wireless system, the influence of the reflected wave can be reduced and the fading is suppressed. The circularly polarized antenna forms electromagnetic waves which have two directional components intersecting perpendicularly. Therefore, generally, the circularly polarized antenna must have a planar structure.

In a wireless system for telecommunications using electromagnetic waves whose frequency is between 800 MHz and 900 MHz and a circularly polarized antenna, the dimension of the antenna is as large as 10 square centimeters. Therefore, when a terminal is stuck on an object be identified by the wireless system, it may cover a meaningful symbol which the object originally has on its surface. Moreover, when installing the antenna of the base station at places such as a wall and a ceiling, which requires aesthetic preference, a visible form of the antenna may cause disfigurement of those places.

A principal problem to be solved by the invention is to provide, in a system for identifying an object by using wireless technology, and when there is a demand for making a distance between a device (a base station) for executing identification and a device (a terminal) attached to the object to be identified longer, an antenna of originally planar structure which is not disturbing in aesthetic terms and which does not cover meaningful symbols, and a wireless system using the antenna.

A typical example of the present invention is as follows. That is, a skeleton equalizing antenna of the present invention has a planar structure including a conductor grid which has roughness and fineness around a feeding point. Further, its frequency spectrum viewed from the feeding point to the antenna has two or more stationary points.

According to the present invention, it is possible to realize a circularly polarized antenna of a planar structure or an antenna which has an equalizing function to intentionally distort a frequency characteristic of the electromagnetic wave sent and received through the antenna while sufficiently maintaining visible-light transmissivity. Thus, the antenna has been realized without causing deterioration in aesthetic terms and covering meaningful symbols.

DETAILED DESCRIPTION OF THE PREFERRED EMBODIMENTS

According to a typical embodiment of the present invention, in an RFID tag and an RFID system using the tag, such an antenna is used that has a grid structure with roughness and fineness around a feeding point and with density allowing a visible light to pass through, and has a circularly polarizing function and a frequency equalizing function.

A planar circularly polarized antenna can be obtained by assuming an appropriate region, dividing the region into sufficiently fine regions (less than 1/100 wavelength) as compared with a wavelength, and checking all the combinations of the presence and absence of a conductor in the fine regions on a round-robin method. In this regard, since high frequency currents are distributed two-dimensionally over the surface of the conductor according to a skin effect, it can be developed on two perpendicularly intersecting axes on the surface. Moreover, since the dimension of the fine region is sufficiently small as compared with the wavelength, the high-frequency current in a fine region can be expressed in approximating manner by using line currents on the two axes around the center of the fine region. Therefore, an operation of the antenna whose portion without the line current in the fine region is extracted is equivalent to an original operation of the antenna. An actual electric conductor is not a perfect conductor in the high-frequency region and contains limited high-frequency resistance. Therefore, if the region of the extracted portion is large, the high-frequency resistance of a remaining portion increases, which deteriorates the efficiency of the antenna. Then, all that has to be done is to find a specific dimension of the portion to be extracted from the fine region for an optimal structure by using the relationship of the tradeoff between the transmissivity of the visible light and the high-frequency resistance.

Embodiment 1

Figure 1:
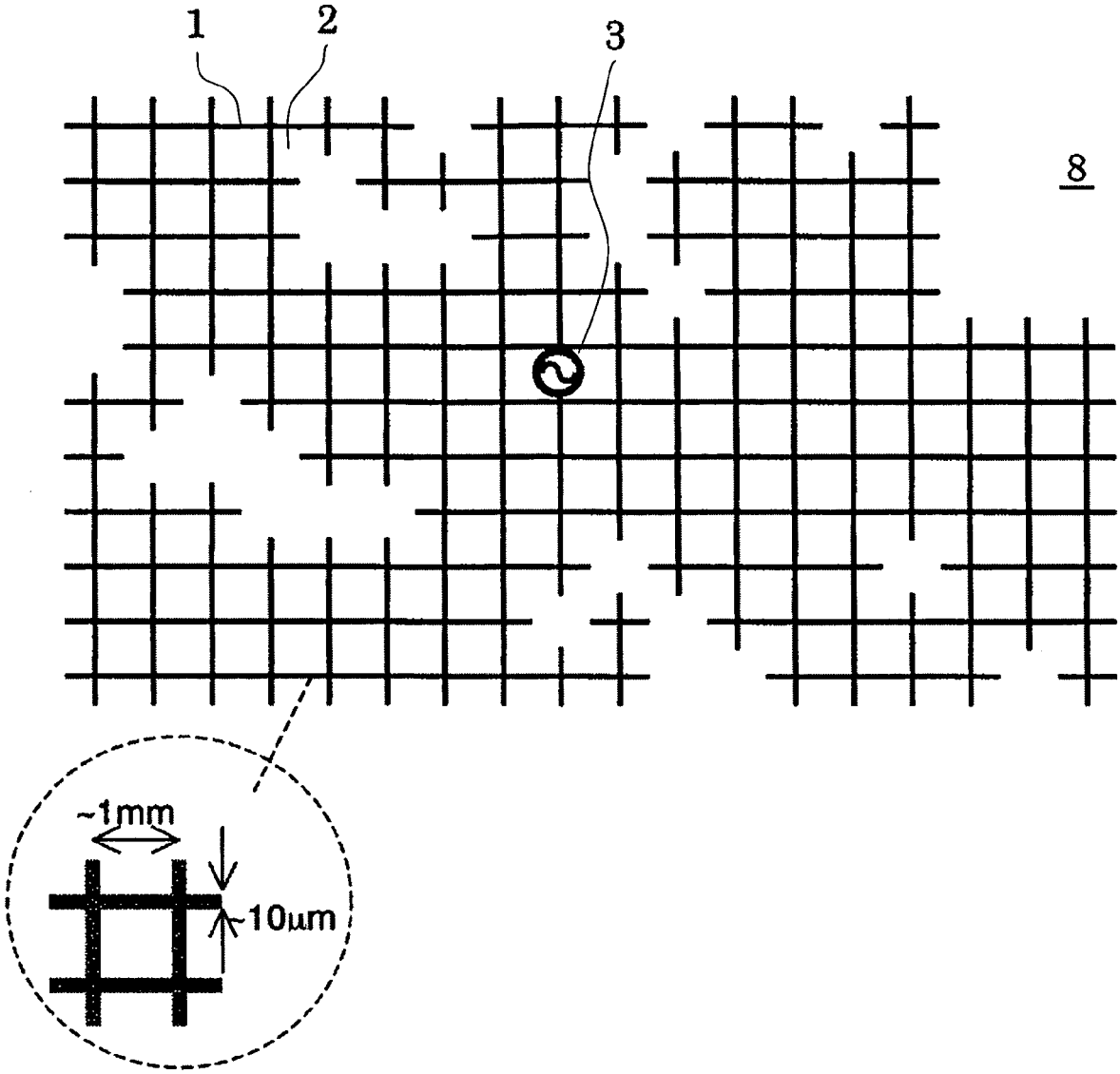
FIG. 1 shows a structure of a skeleton equalizing antenna according to a first embodiment of the present invention.

Now, an embodiment of the present invention will be described with reference to FIG. 1. FIG. 1 shows a structure of a skeleton equalizing antenna according to the embodiment of the present invention. In the skeleton equalizing antenna 8, a grid with different roughness and fineness provided around a feeding point 3 has a planar structure including linear conductors 1 and spacing 2 between the linear conductors.

That is, the antenna 8 of the present embodiment is composed of a planar structure including the conductive grid which has roughness and fineness around the feeding point 3. The frequency spectrum viewed from the feeding point 3 of the antenna has two or more stationary points. In other words, in plural frequencies, the antenna 8 of the present embodiment has a structure which satisfies a desired feeding-point impedance matching condition.

In the planar structure of the antenna 8 of the present embodiment, a ratio of a width for constituting the conductor grid structure to the spacing between conductors is high enough such that an object can be visually seen through the grid structure. For example, a width of the linear conductor is 20 μm or less, and preferably 10 μm or less. The minimum spacing between the linear conductors is 1 mm or less.

The antenna 8 of the present embodiment is a circularly polarized antenna. The structure of the circularly polarized antenna is obtained in the following manner. First, it is assumed that there are two axes intersecting perpendicularly in a plane where the grid of FIG. 1 is formed. Then, in order that a vector sum of a projection of a current distribution on the linear conductors to the two axes has substantially the same amplitude and a phase difference is substantially 90 degrees, from the structure where the grid is formed uniformly without any missing part in all the region (surface region of a predetermined size) shown in FIG. 1, a portion of a side of a square mesh of the grid structure, which is a minimum element of the linear conductors making up the grid, is deleted one by one. Subsequently, the structure of the antenna is obtained by verifying all the combinations of presence or absence of the minimum element on a round-robin method in the predetermined plane region. That is, the predetermined plane region is divided into sufficiently fine regions (less than 1/100 wavelength) as compared with a wavelength. Then, by checking all the combinations of the presence or absence of the conductor in each fine region on a round-robin method, the structure of the antenna can be obtained. The amplitude of the vector sum of the above is equal to or less than two times and the phase difference is about 80 degrees.

In exactly the same manner, such an antenna as possesses an equalizing function of intentionally distorting frequency characteristics of electromagnetic waves that the antenna sends and receives can be obtained by verifying all the combinations of the presence or absence of the minimum element on a round-robin method and finding a structure which satisfies a desired feeding-point impedance matching condition in two ore more frequencies.

According to the present embodiment, a circularly polarized antenna of a planar structure can be realized while sufficiently maintaining the visible-light transmissivity. Therefore, it brings about the effect of making it possible to read a symbol when the antenna is installed on a surface where a meaningful symbol is printed.

Embodiment 2

Figure 2:
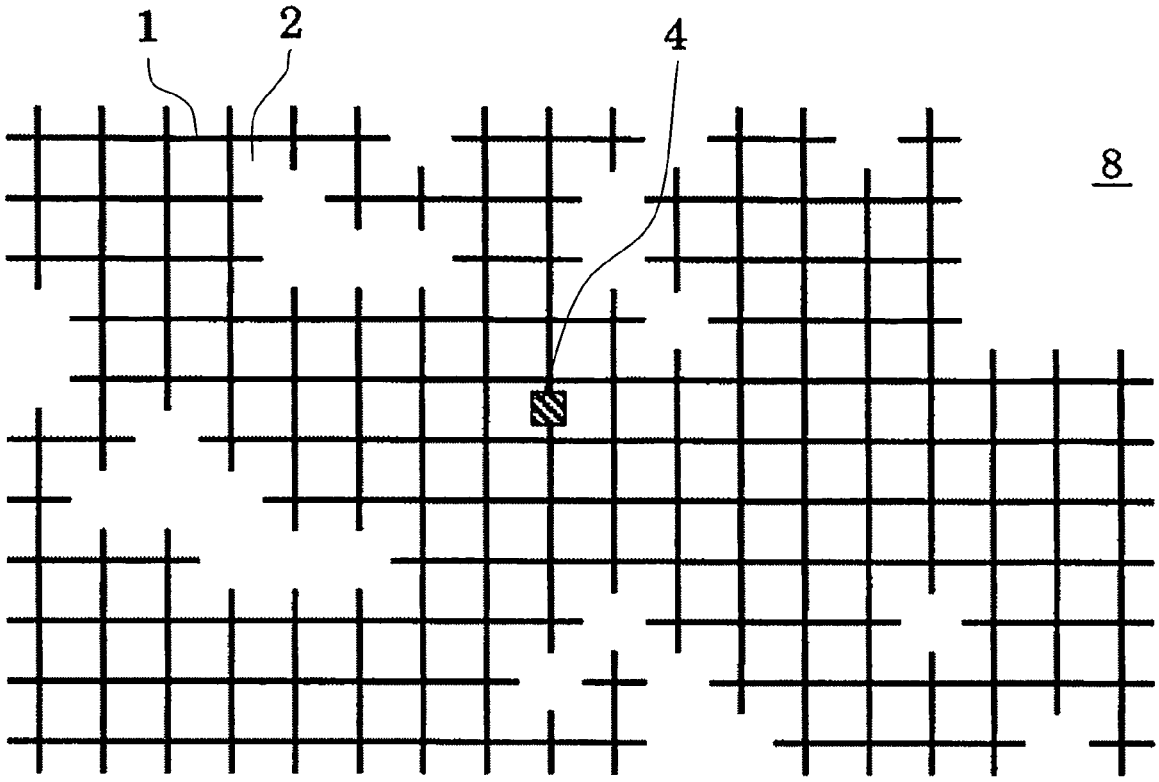
FIG. 2 shows a structure of an RFID tag using the skeleton equalizing antenna of the embodiment of FIG. 1.
Figure 3:
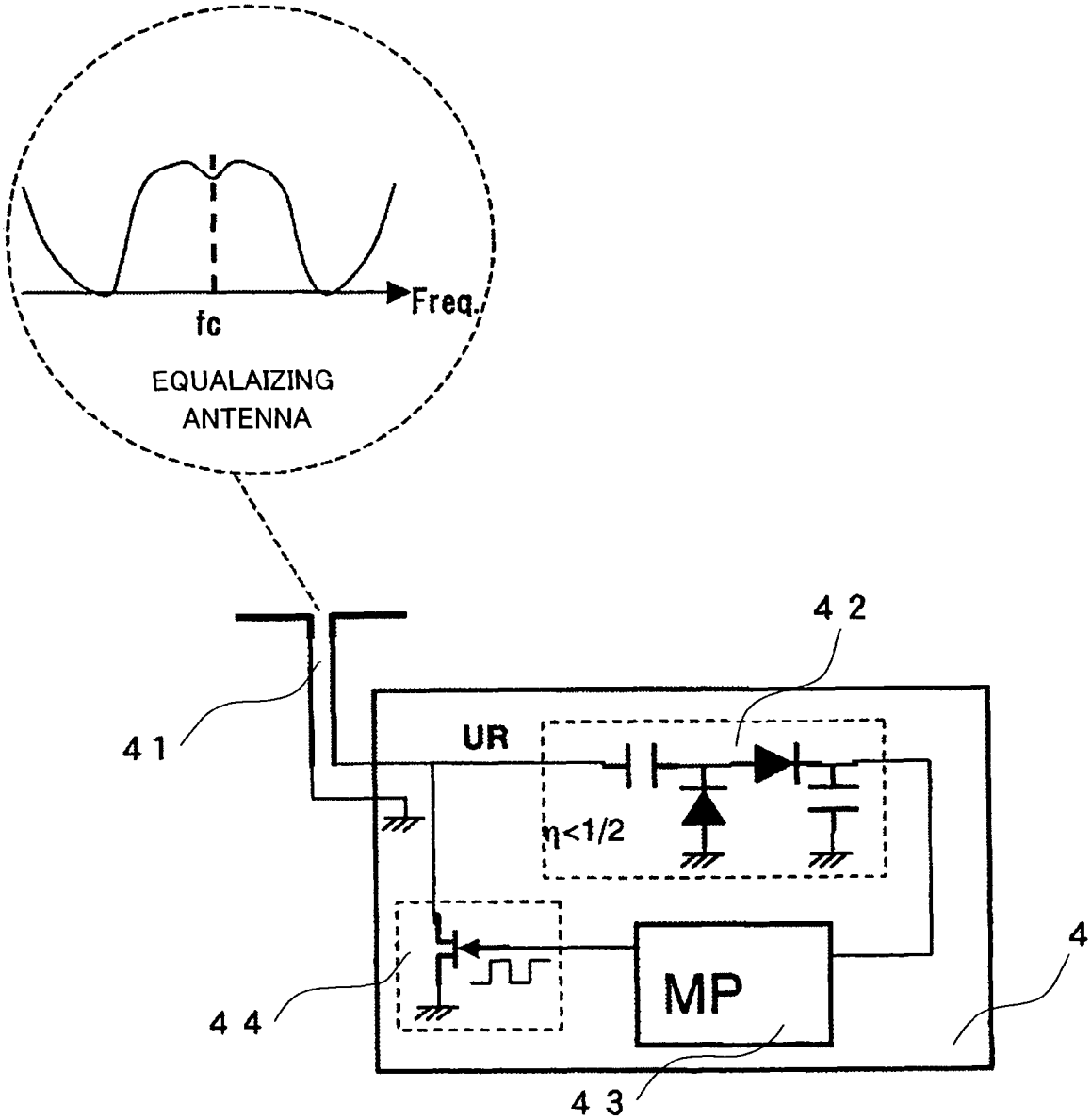
FIG. 3 shows a circuit configuration of an RFID chip in FIG. 2.

Referring to FIGS. 2 and 3, another embodiment of the present invention will be described. FIG. 2 shows a structure of an RFID tag using a skeleton equalizing antenna of the present invention. The structure is such that a high-frequency input/output point of the RFID chip 4 is connected to a feeding part 3 of the skeleton equalizing antenna 8. An example of a circuit diagram of the RFID chip 4 is shown in FIG. 3. The energy of electromagnetic waves transmitted from a base station through a skeleton equalizing antenna 41 is taken in, and is converted to a direct-current power supply in a rectifier circuit 42. A microprocessor 43 operated by the direct-current power supply drives a modulation circuit 44, modulation is applied on load impedance of the antenna 41, and the electromagnetic wave in which an amplitude of the received wave is modulated is emitted from the antenna 41.

According to the present embodiment, a circularly polarized antenna of a planar structure can be realized while sufficiently maintaining the transmissivity of visible light. Therefore, a fading phenomenon caused by reflected waves taking place when an RFID system contains a reflector for indoor electromagnetic waves in the wireless system can be suppressed. Accordingly, when the RFID tag is installed on a surface where a meaningful symbol is printed, it is possible to read the symbol and to increase the communication distance between a base station and terminals (a reader and tags) of the RFID system, bringing about the effect of expanding a service area of the RFID system.

Embodiment 3

Figure 4:
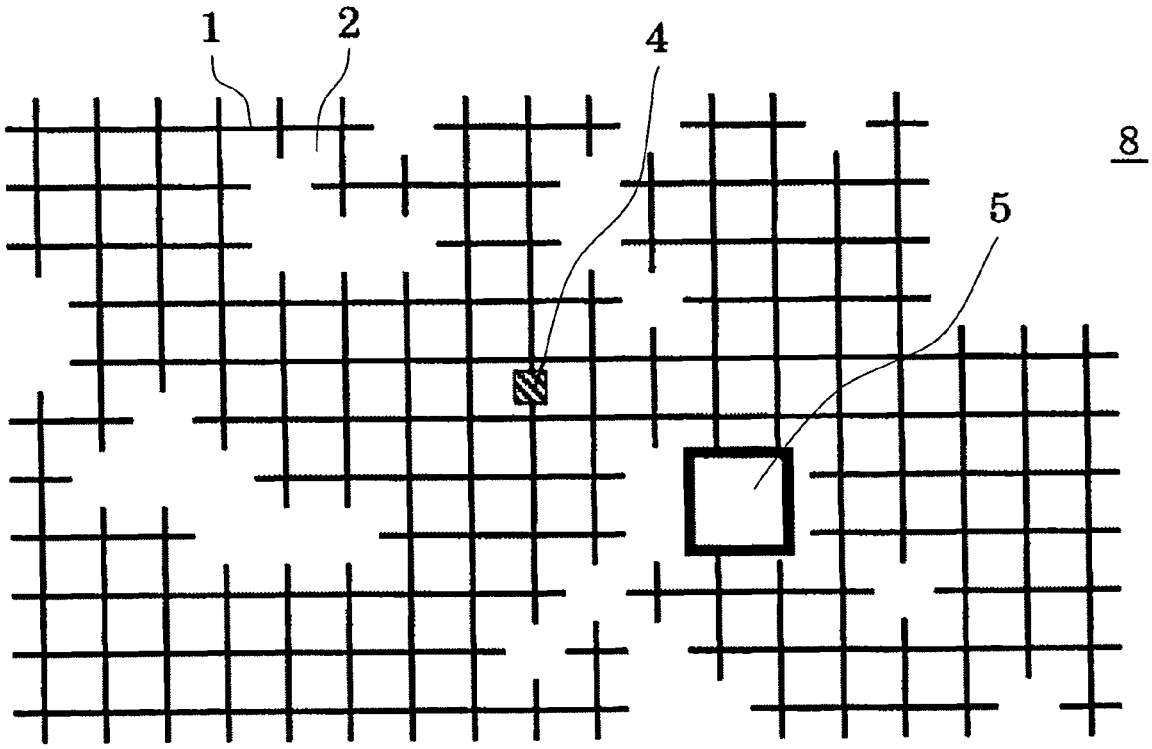
FIG. 4 shows a structure of an RFID tag using a skeleton equalizing antenna according to another embodiment of the present invention.

With reference to FIG. 4, another embodiment of the present invention will be described. FIG. 4 shows a configuration of another embodiment of the RFID tag using the skeleton equalizing antenna of the present invention. The present embodiment differs from the embodiment of FIG. 2 in that, besides the RFID chip 4, an electronic circuit 5 is provided inside the skeleton equalizing antenna. In general, the RFID chip includes an analog circuit and a digital circuit, and a high-frequency part of the analog circuit has a circuit which depends on a frequency in which the RFID tag operates. Since the circuit uses undulations peculiar to electromagnetic waves, there arises a need to use a transmission line, an inductive element, and a large capacity element. As a result, it is difficult to provide such a circuit inside the RFID which is physically restricted to a small region. These elements are replaced with circuitry using an electronic circuit in a conventional technology. However, since power consumption of an electronic circuit element is larger than that of an electric circuit element, it is not suitable for an RFID tag which strongly requires suppression of power consumption, especially a passive RFID tag.

According to the present embodiment, an analog circuit described above can be provided, separately from the RFID chip, inside the electronic circuit 5 with a large region. Also, the electric connection with the RFID chip can be realized by using linear conductors which are components of the skeleton equalizing antenna.

According to the present embodiment, an analog circuit whose power consumption is small can be provided inside the skeleton equalizing antenna. Since the power consumption of the RFID tag can be reduced while making it possible to read the symbol, it becomes possible to increase the communication distance between a base station and a terminal (a reader and a tag) of the RFID system, which brings about the effect of expanding the service area of the RFID system.

Embodiment 4

Figure 5:
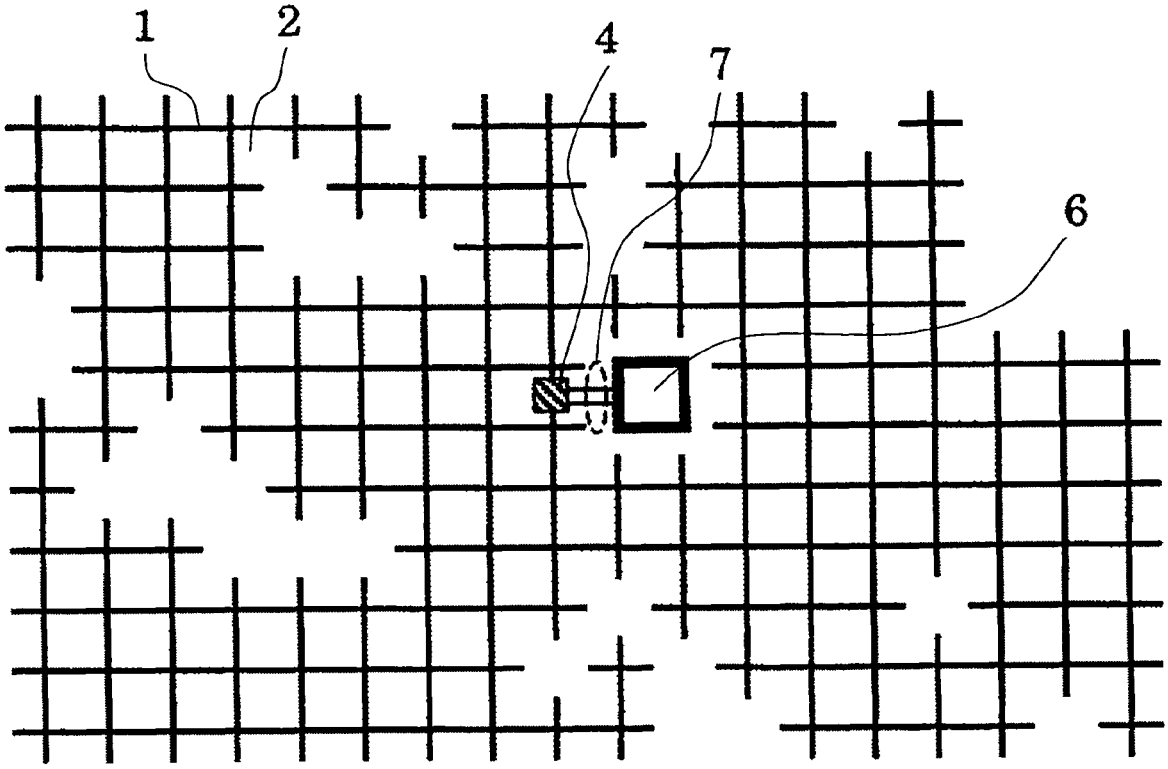
FIG. 5 shows a structure of an RFID tag using a skeleton equalizing antenna according to another embodiment of the present invention.

Another embodiment of the present invention will be described with reference to FIG. 5. FIG. 5 shows a configuration of another embodiment of the RFID tag using the skeleton equalizing antenna of the present invention. The present embodiment differs from the embodiment of FIG. 2 in that, besides the RFID chip 4, a rectifier circuit 6 is provided inside the skeleton equalizing antenna and is connected to the RFID chip 4 with a wire 7.

A passive RFID chip generally includes a rectifier circuit, and takes high-frequency electric power emitted from the base station into the RFID chip by an antenna, rectifies the high-frequency electric power by using a diode, and uses it as a power supply for the electronic circuit inside the RFID. Therefore, efficiency of the rectifier circuit is very important for reducing power consumption of the RFID tag. The electric power taken in from the outside by the RFID tag is small (because of a long distance between the base station and the terminal) and the electric power to be dealt with is of high frequency. Therefore, it is effective presently to adopt a Schottky barrier diode for improving efficiency of the rectifier circuit. A threshold voltage of the Schottky barrier diode for rectifying operation is low, and it has a characteristic of reducing parasitic capacitance. In order to reduce manufacturing cost and to improve eco-friendliness, in general, an RFID chip is produced by using a silicon process. Therefore when the Schottky barrier diode is provided inside the RFID chip, since a process of controlling an interface between a metal and a semiconductor with high precision is added, the manufacturing cost of the chip goes up. Moreover, since the RFID chip in itself consists of an unbalanced circuit, it is difficult to form a full-wave rectifier circuit which is a balanced circuit having an effect of improving efficiency of the rectifier circuit.

According to the present embodiment, the full-wave rectifier circuit using the Schottky barrier diode is formed near the RFID chip. Further, the connection with the RFID chip is made by using the wire 7 which is narrower than a linear conductor 1 which is a component of the skeleton equalizing antenna. That is, the RFID chip 4 which is an unbalanced circuit and the rectifier circuit 6 which is a balanced circuit are connected by using the thin wire 7. A surface area per unit length of the conductor of the high-frequency current induced in the wire 7 is smaller than that of a high-frequency current induced in the linear conductor 1, and its electric-current value is also small. As a result, the influence of the wire 7 to an operation of the skeleton equalizing antenna becomes small. In other words, the disturbance to the wire 7 of the high-frequency electric power handled by the skeleton equalizing antenna can also be reduced.

According to the present embodiment, the rectifier circuit of good rectifying efficiency can be provided inside the skeleton equalizing antenna while reducing interference with a high-frequency electric power handled by the skeleton equalizing antenna. Therefore, it is possible to increase the rectification power for the RFID tag while making it possible to read a symbol. As a result, it is possible to increase the communication distance between the base station and the terminal (the reader and the tag) of the RFID system, bringing about the effect of expanding the service area of the RFID system.

Embodiment 5

Figure 6:
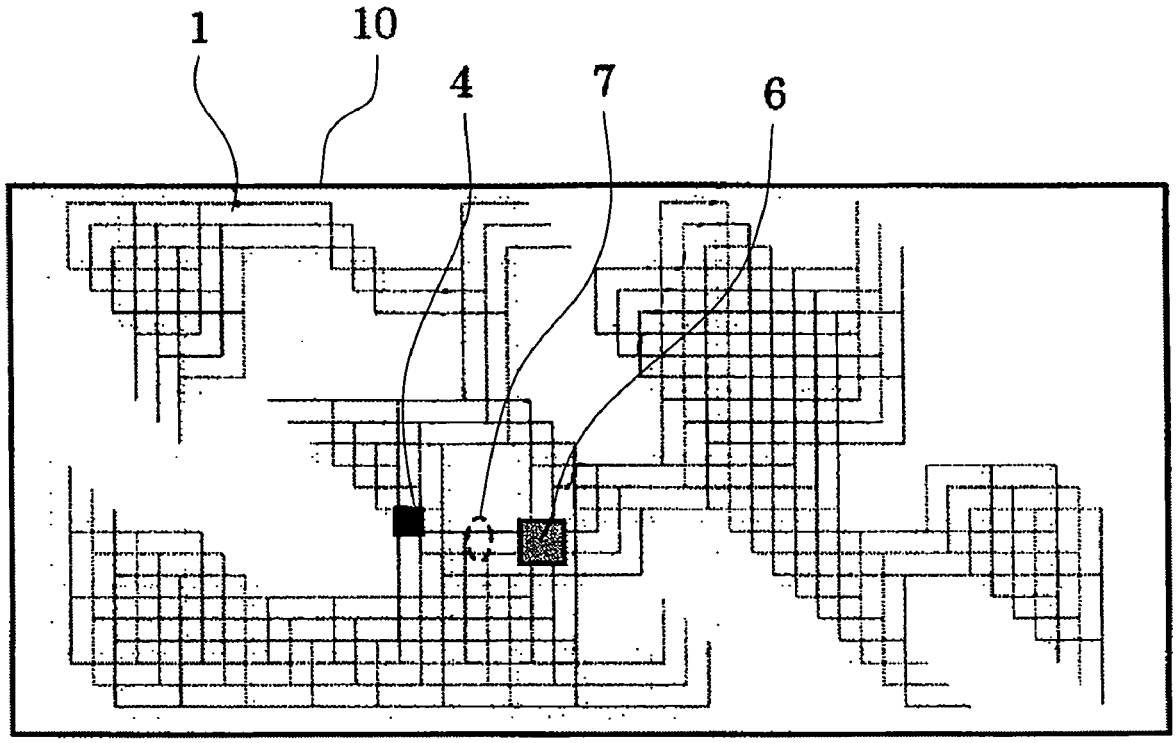
FIG. 6 shows a structure of an RFID tag using a skeleton equalizing antenna according to another embodiment of the present invention.

Another embodiment of the present invention will be described with reference to FIGS. 6 and 7. FIG. 6 shows a configuration of another embodiment of the RFID tag using the skeleton equalizing antenna of the present invention. A rectifier circuit 6 is provided separately from the RFID chip 4 in the skeleton equalizing antenna and is connected to the RFID chip 4 by using the wire 7. The present embodiment differs from the embodiment of FIG. 5 in that the RFID tag is formed on a visible-light transmissive flexible substrate 10.

Figure 7:
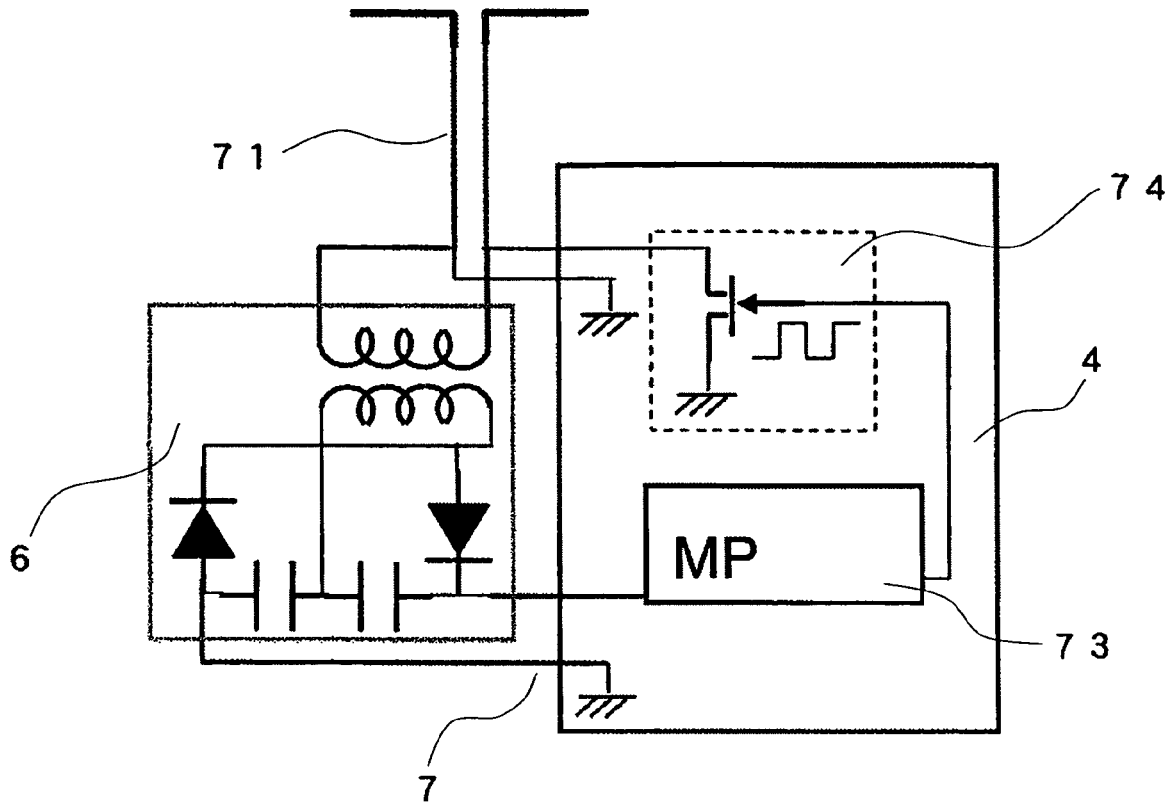
FIG. 7 shows a circuit configuration of an RFID tag in the embodiment FIG. 6.

FIG. 7 shows a circuit diagram of the RFID tag. The energy of the electromagnetic wave transmitted from the base station is taken in by an antenna 71, and is converted to a direct power supply in the rectifier circuit 6 including diodes, M, L, C, and R. A microprocessor 73 operated by the direct-current power supply drives a modulation circuit 74, and modulation is applied on load impedance of the antenna 71. Further, the electromagnetic wave whose received wave's amplitude is modulated is emitted from the antenna 71.

The RFID tag using a skeleton equalizing antenna of the present structure is manufactured in the following manner. First, 1) a uniformly-dense conductor grid pattern is formed on a visible-light transmissive flexible substrate 10 by printing or etching. Then, 2) a grid pattern with roughness and fineness, a pattern of the wiring 7, and a wiring pattern of the electronic circuit 6 are formed on a product of the previous process by applying a photolithographic mask and by etching. Subsequently, 3) by applying a metal mask for soldering on the electronic circuit, a solder paste is applied to the product of the previous process. Further, 4) after mounting components of the electronic circuit on the product of the previous process, they are packaged in a heating process. Subsequently, 5) an RFID chip is mounted on the product of the previous process by proper means, and finally 6) the RFID packaged part is coated and protected with a high-frequency resin etc. to complete the manufacturing process. It is also possible to execute the processes 1) and 2) directly and collectively by a conductor printing technology.

In the present embodiment, a pattern of such a grid is adopted from which a (floating) portion of the grid where one end is not connected by unit of a fine structure, which may cause malfunction in the etching process, is removed in advance.

In addition to the effect of the embodiment of FIG. 5, the present embodiment has an effect of reducing the manufacturing cost of the RFID tag using the skeleton equalizing antenna by application of a mass-production technology.

Embodiment 6

Figure 8:
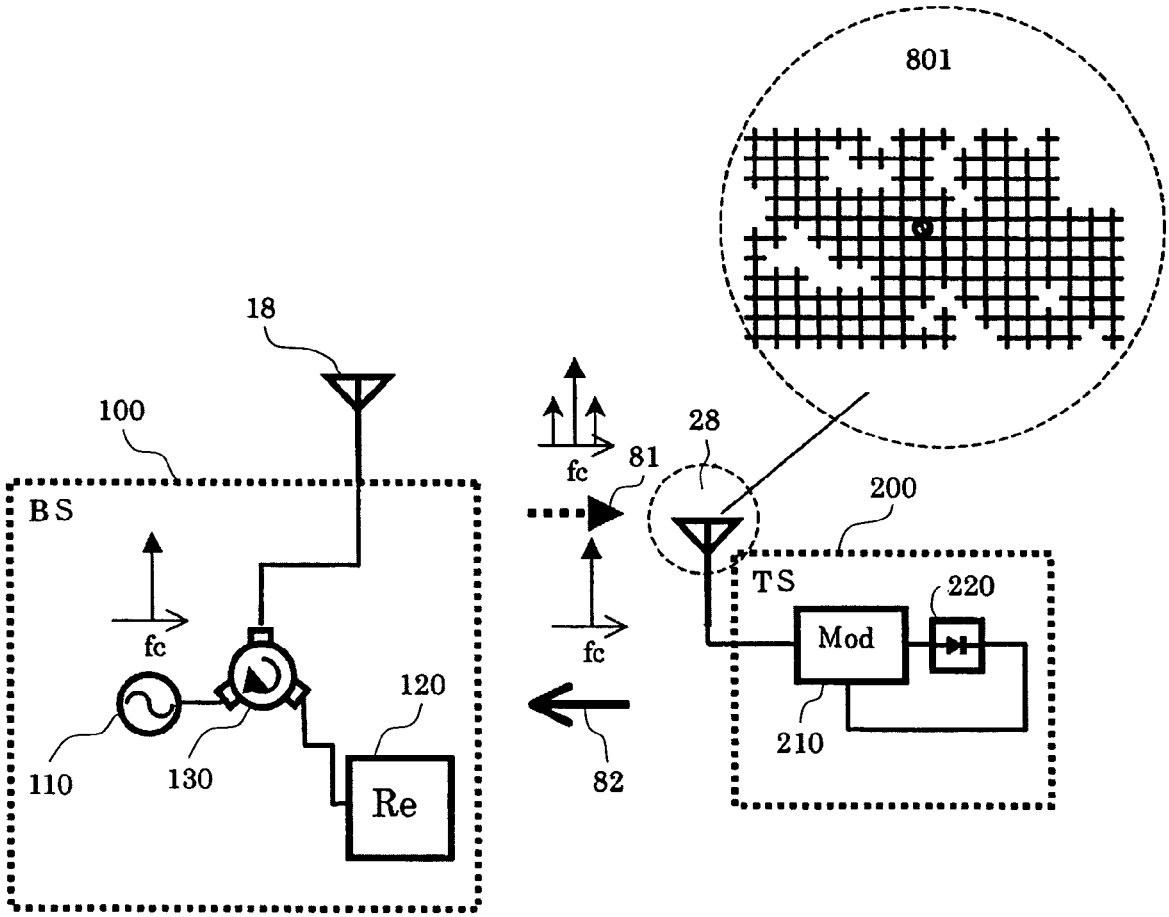
FIG. 8 shows a configuration of an RFID system using a skeleton equalizing antenna according to another embodiment of the present invention.

Another embodiment of the present invention will be described with reference to FIG. 8. FIG. 8 is a block diagram of an RFID system having an RFID tag using the skeleton equalizing antenna of the present invention as a component. The system includes a base station 100 which has a base station antenna 18 and a terminal 200 which has a terminal antenna 28. The output of a carrier-wave generator 110, which is a source of transmitting power sent from the base station 100, is emitted from the antenna 18 through a circulator 130. The transmitting power 81 sent from the base station 100 arrives at the terminal 200, the energy of the transmitting power is taken in by the terminal antenna 28, and is converted to a direct-current power supply by a rectifier circuit 220. By using the direct-current power supply, modulation is applied on load impedance of the antenna 28 by a modulation circuit 210, and is emitted as a reflected wave 82 whose amplitude is modulated. The reflected wave which arrives at the base station 100 again is transmitted to a receiving circuit 120 through the circulator 130 by the antenna 18.

As the terminal antenna 28, a skeleton equalizing antenna 801 of the present invention is adopted.

In an RFID system, the transmitting power 81 transmitted to the terminal from the base station and the reflected wave 82 sent to the base station from the terminal have a spectrum spreading over a frequency wave region. Therefore, frequency other than a principal frequency of the electromagnetic wave inputted to the terminal from the terminal antenna is distorted. A transmission wave sent from the antenna on the sending side is given distortion in advance of the reverse characteristic of the distortion generated at the antenna on the receiving side and transmitted. The antenna having such an equalization function can be found by assuming an appropriate region, dividing the region into sufficiently fine regions (less than 1/100 wavelength) as compared with the wavelength, and checking all the combinations of the presence or absence of a conductor in the fine region on a round-robin method.

According to the present embodiment, the effect of the embodiment of FIG. 1 can be realized in an actual RFID system.

Embodiment 7

Figure 9:
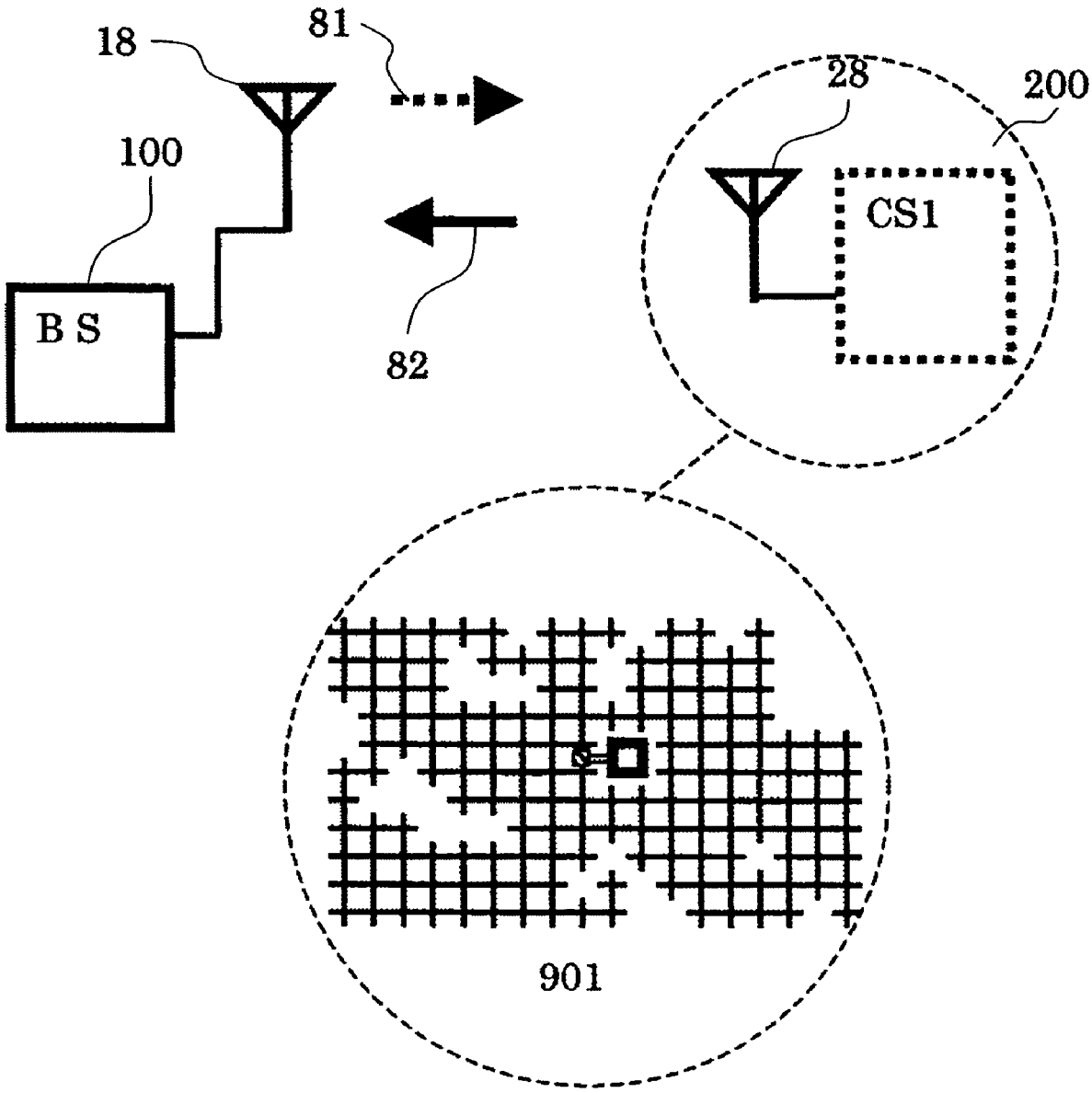
FIG. 9 shows a configuration of an RFID system using a skeleton equalizing antenna according to another embodiment of the present invention.

Another embodiment of the present invention will be described with reference to FIG. 9. FIG. 9 is a block diagram of an RFID system of an embodiment having an RFID tag using the skeleton equalizing antenna of the present invention as a component. The present embodiment differs from the embodiment of FIG. 8 in that the terminal 200 having the terminal antenna 28 is realized in the form of an RFID tag 901. According to the present embodiment, the effect of Embodiment 4 can be realized in an actual RFID system.

Embodiment 8

Figure 10:
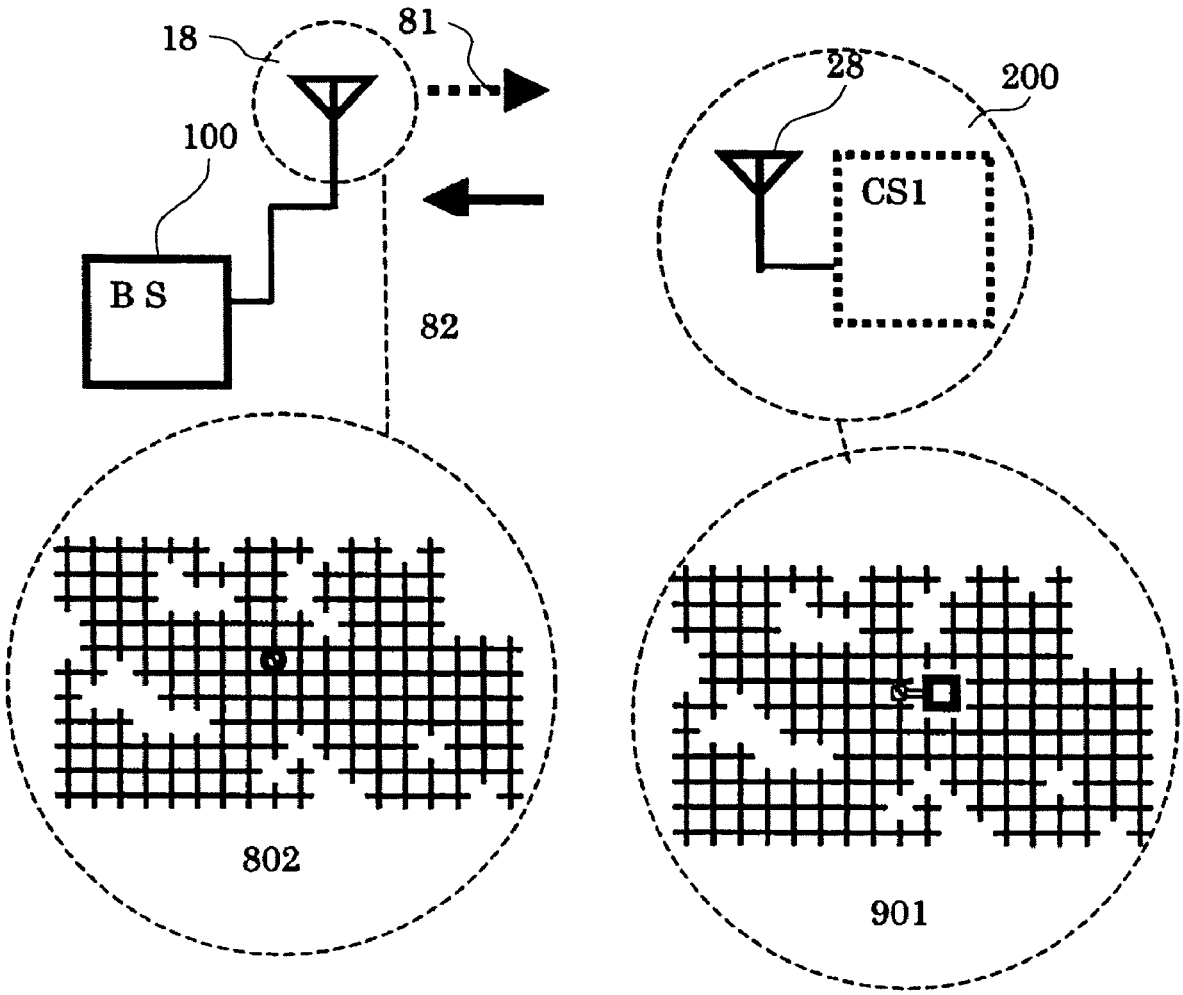
FIG. 10 shows a configuration of an RFID system using a skeleton equalizing antenna according to another embodiment of the present invention.

Another embodiment of the present invention will be described with reference to FIG. 10. FIG. 10 is a block diagram of an RFID system according to another embodiment having an RFID tag using the skeleton equalizing antenna of the present invention as a component. The terminal 200 having the terminal antenna 28 is realized in the form of an RFID tag 901. The present embodiment differs from the embodiment of FIG. 9 in that a skeleton equalizing antenna 802 of the present invention is also applied to the base station antenna 18. According to the present embodiment, the effect of Embodiment 1 can be realized in an actual RFID system.

Embodiment 9

Figure 11:
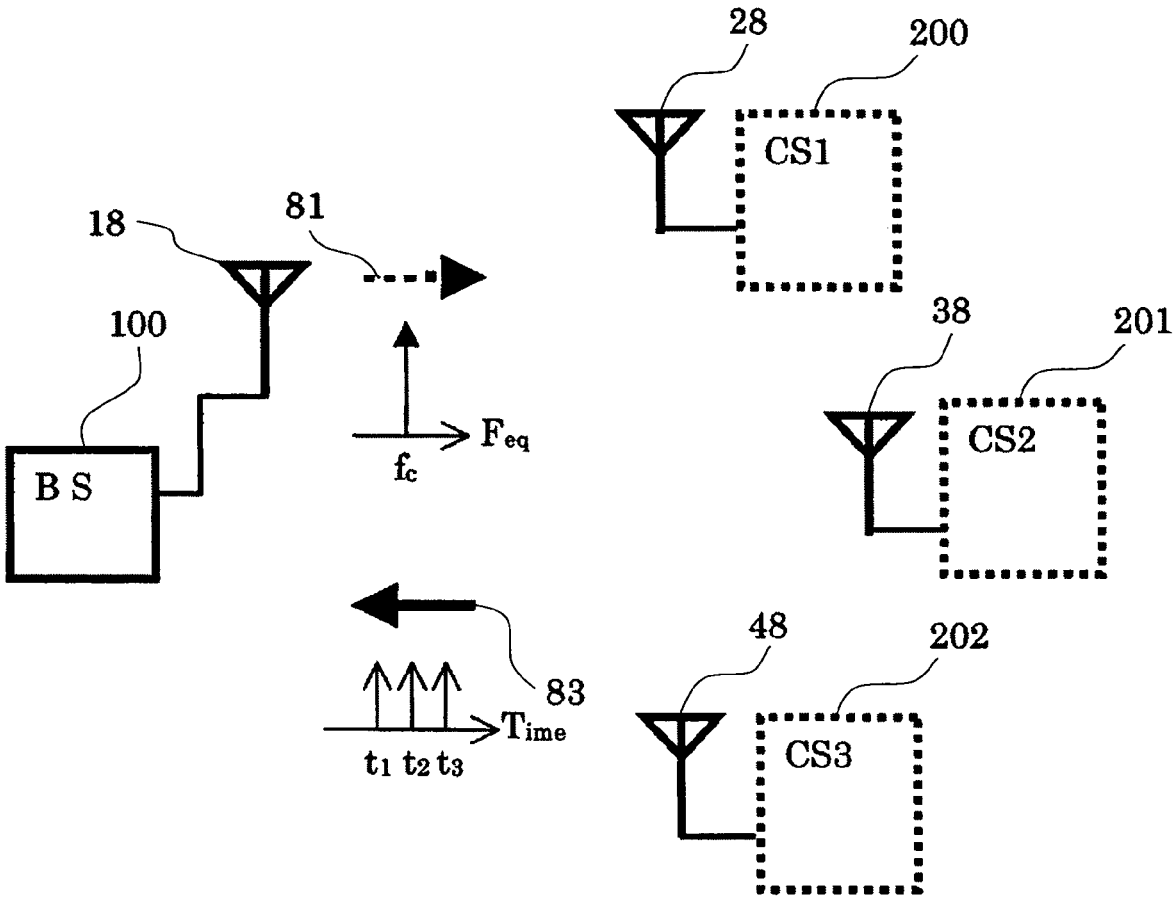
FIG. 11 shows a configuration of an RFID system having two or more terminals according to another embodiment of the invention.

Another embodiment of the present invention will be described with reference to FIG. 11. FIG. 11 shows, in a waveform-equalizing intermittent transmission wireless system of the present invention, a system configuration where there exist one base station and two or more terminals. In FIG. 11, there are three terminals, and the base station needs to recognize each of them. The base station 100 has an antenna 18. A first terminal 200, a second terminal 201, and a third terminal 202 respectively have functions similar to those of the RFID tags described in the above embodiments, and also have skeleton equalizing antennas 28, 38, and 48, respectively. The three terminals communicate with the base stations 100 by using radiation electromagnetic fields 81 and 83. The radiation electromagnetic fields intermittently transmitted are waveform-equalized by the skeleton equalizing antenna. Each terminal sends out a reflected wave modulated by an on/off-pattern of a changeover switch according to contents stored in its memory at different timing in terms of time series.

With the above arrangement, in a certain period, it becomes possible to shift the outgoing timing of scattered electromagnetic waves from the antennas 28, 38, and 48 of the terminals. When the timing is detected by the base station, it becomes possible to identify these three terminals. In FIG. 11, numeral 81 shows the spectrum of the electromagnetic field radiated from the base station. Of the electromagnetic waves reflected by the three terminals, the timing of modulated portions having their unique information is shown in time series by numeral 83.

According to the present embodiment, the base station can identify two or more terminals, which brings about the effect of increasing communication capacity as a waveform-equalization intermittent transmitting wireless system.

Embodiment 10

Figure 12:
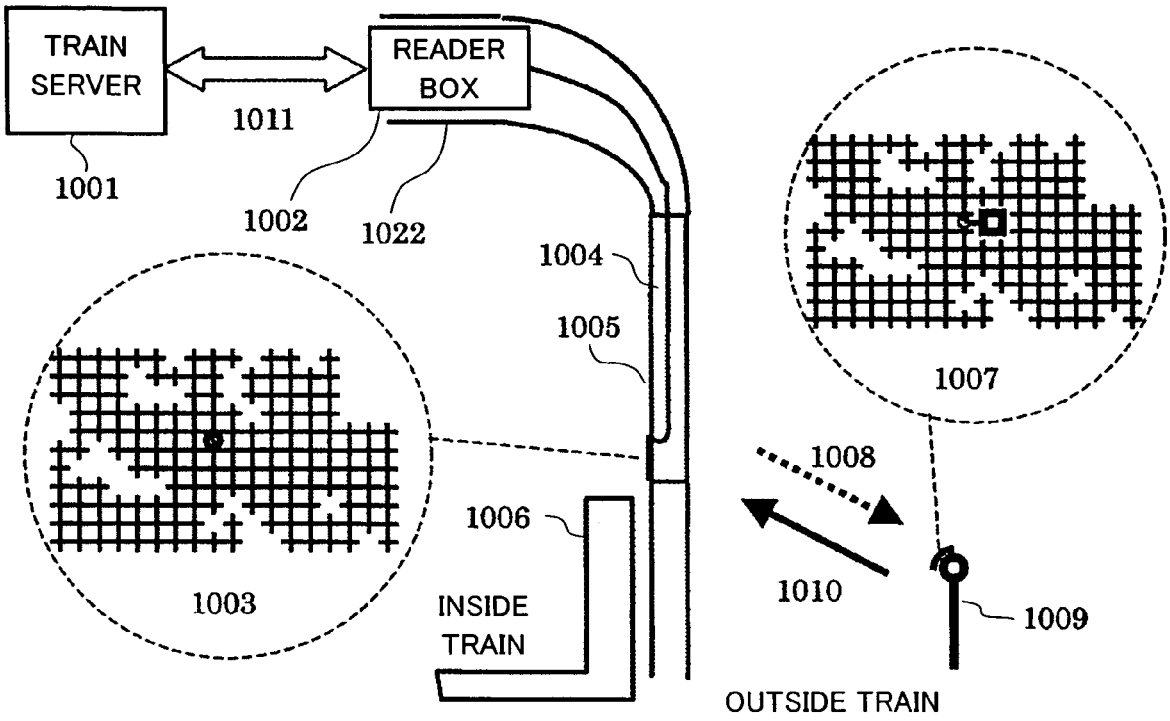
FIG. 12 is a diagram showing a business model to which the RFID system of the present invention is applied.

Another embodiment of the present invention will be described with reference to FIG. 12. FIG. 12 shows one business model to which the waveform-equalization intermittent transmitting wireless system of the present invention is applied. In FIG. 12, a base station is installed inside a car of a train, and two or more terminals having functions similar to those of the RFID tags described in the above embodiments are installed outside the train. A base station antenna 1003 constituted as the skeleton equalizing antenna of the present invention is stuck on an upper back of a chair 1006 beside a window pane 1005 or on the window pane. A base station (a reader box) 1002 installed inside a ceiling 1022 and the antenna 1003 of the base station are connected by using a high-frequency cable 1004. The base station 1002 is connected to a train server 1001 appropriately placed inside the car by using a wired network 1011.

The terminal 1007 stuck on an upper portion of the protective fence 1009 outside the train, which is an RFID tag using the skeleton equalizing antenna of the invention, receives transmitting power 1008 sent from the base station antenna 1003, and transmits certain information carried on a reflected wave 1010 to the base-station antenna 1003. An ID of the protective fence is recorded in advance on the terminal 1007, and the base station 1002 receives the ID as information from the terminal 1007 and sends it to the server 1001. On the server 1001, the ID and information corresponding to map information are recorded in advance and, by using a suitable man-machine interface, the server can inform a driver, a train conductor, passengers, etc. of a position of the train.

The present embodiment brings about an effect of providing accurate location information to a user with a simple configuration using a wireless system.

What is claimed is:

1. A skeleton equalizing antenna comprising a planar structure having a conductor grid with roughness and fineness around a feeding point, wherein a frequency spectrum viewed from the feeding point to the antenna has plural stationary points.

2. The skeleton equalizing antenna according to claim 1, wherein a ratio of a width constituting the planar structure having the conductor grid to a spacing between conductors is sufficiently high such that an object can be visually seen through the planar structure.

3. The skeleton equalizing antenna according to claim 1, wherein the skeleton equalizing antenna having a circular polarization characteristic.

4. The skeleton equalizing antenna according to claim 1, wherein the skeleton equalizing antenna satisfying a desired feeding point impedance matching condition in plural frequencies and having an equalizing function of purposely distorting a frequency characteristic of an electromagnetic wave sent and received through the antenna.

5. An RFID tag comprising:

a skeleton equalizing antenna having a planar structure including a conductor grid with roughness and fineness around a feeding point, wherein a frequency spectrum viewed from the feeding point to the antenna has plural stationary points; and an IC chip mounted on the feeding point of the planar structure.

6. The RFID tag according to claim 5, wherein the IC chip comprises:

a rectification unit for rectifying energy of an electromagnetic wave taken in by the antenna and converting the energy to a direct-current power supply; and a modulation unit for modulating the electromagnetic wave.

7. The RFID tag according to claim 5, further comprising a rectifier circuit provided on the planar structure, wherein the IC chip comprises a modulation unit for modulating an electromagnetic wave taken in through the antenna by using output of the rectifier circuit as a power supply.

8. The RFID tag according to claim 7, wherein the rectifier circuit includes a balanced circuit.

9. The RFID tag according to claim 7, wherein a wiring structure for connecting circuits including a coupling wire path between the rectifier circuit and the IC chip is integrally formed on the skeleton equalizing antenna.

10. The RFID tag according to claim 9, wherein the wiring structure is formed using the conductor grid.

11. The RFID tag according to claim 7, wherein the rectifier circuit is constituted using a Schottky barrier diode.

12. The RFID tag according to claim 7, wherein the rectifier circuit is a full-wave rectifier circuit using a Schottky barrier diode.

13. An RFID system comprising an RFID tag and a reader which communicates with the RFID tag, wherein the RFID tag includes:

a skeleton equalizing antenna having a planar structure including a conductor grid with roughness and fineness around a feeding point, wherein a frequency spectrum viewed from the feeding point to the antenna has plural stationary points; and an IC chip mounted on the feeding point of the skeleton equalizing antenna.

14. The RFID system according to claim 13, wherein, in the skeleton equalizing antenna, a ratio of a width constituting the planar structure having the conductor grid to a spacing between conductors is sufficiently high such that an object can be visually seen through the planar structure.

15. The RFID system according to claim 13, wherein the skeleton equalizing antenna has a circular polarization characteristic.

16. The RFID system according to claim 13, wherein an antenna of the reader is a skeleton equalizing antenna in which a ratio of a width constituting the planar structure having the conductor grid to a spacing between conductors is sufficiently high such that an object can be visually seen through the planar structure.

17. The RFID system according to claim 16, wherein the antenna of the reader has a circular polarization characteristic.

18. The RFID system according to claim 13, further comprising a plurality of the RFID tags, wherein each of the RFID tags includes the antenna, wherein each of the RFID tags is so configured as to communicate with one of the readers by using a radiation electromagnetic field, and wherein each of the RFID tags has a unit for modulating, according to contents of the tag's memory inside, the radiation electromagnetic field and sending the field at different timing in terms of time series.

19. The RFID system according to claim 13, wherein the reader is installed inside a train and a plurality of the RFID tags are installed outside the train, and wherein a skeleton equalizing antenna of the reader is stuck on a window pane of the train.

20. The RFID system according to claim 13, wherein the skeleton equalizing antenna of the RFID tag is stuck on a member on which a meaningful symbol is printed.

* * * * *